US005516037A

United States Patent [19]

Okamoto et al.

[11] Patent Number: 5,516,037

[45] Date of Patent: May 14, 1996

[54] PAPER CONTAINER AND STOPPER APPLYING APPARATUS FOR PAPER CONTAINERS

[75] Inventors: Hidehiko Okamoto; Masayo Kajiura; Masataka Okushita; Takahisa Kato, all of Tokyo, Japan

[73] Assignee: Dai Nippon Printing Co., Ltd., Japan

[21] Appl. No.: 341,945

[22] Filed: Nov. 16, 1994

[30] Foreign Application Priority Data

| | | | |
|---|---|---|---|
| Nov. 19, 1993 | [JP] | Japan | 5-312801 |
| Mar. 28, 1994 | [JP] | Japan | 6-079280 |
| Oct. 28, 1994 | [JP] | Japan | 6-265474 |

[51] Int. Cl.[6] ..... B65D 5/42

[52] U.S. Cl. ..... 229/160.2; 229/125.42; 229/249

[58] Field of Search ..... 229/125.42, 160.2, 229/213, 214, 249, 920, 924

[56] References Cited

U.S. PATENT DOCUMENTS

| | | | |
|---|---|---|---|
| 3,520,464 | 7/1970 | Pugh . | |
| 4,589,943 | 5/1986 | Kimball et al. . | |
| 4,821,950 | 4/1989 | Sanchez et al. | 229/160.2 |
| 4,874,126 | 10/1989 | Miller | 229/160.2 |
| 4,883,222 | 11/1989 | Fujisawa . | |
| 5,333,735 | 8/1994 | Focke et al. | 229/160.2 |

FOREIGN PATENT DOCUMENTS

| | | | |
|---|---|---|---|
| 87839 | 9/1983 | European Pat. Off. | 229/214 |
| 2650092 | 5/1978 | Germany | 229/214 |
| 9300551 | 4/1993 | Germany . | |
| 62-26345 | 7/1987 | Japan . | |
| 63-52727 | 4/1988 | Japan . | |
| 1-137821 | 9/1989 | Japan . | |
| 2-28424 | 2/1990 | Japan . | |
| 2-34433 | 3/1990 | Japan . | |
| 2-23421 | 5/1990 | Japan . | |
| 3-27953 | 6/1991 | Japan . | |
| 4189744 | 7/1992 | Japan | 229/160.2 |
| 60-24438 | 2/1994 | Japan | 229/160.2 |
| 2160169 | 12/1985 | United Kingdom . | |
| 253608 | 9/1992 | United Kingdom . | |
| 80/02826 | 12/1980 | WIPO . | |
| 8203370 | 10/1982 | WIPO | 229/160.2 |
| 9425352 | 11/1994 | WIPO | 229/125.42 |

*Primary Examiner*—Gary E. Elkins
*Attorney, Agent, or Firm*—Parkhurst, Wendel & Burr

[57] ABSTRACT

A paper container according to the present invention includes a tab region half cut for defining a tab region of a shape whose lower part is closed and whose upper part is opened in the substantially central part of one of top folded-in side panels. A stopper is applied to an upper end of the tab region or near the upper end. The tab region is pulled from below after a pair of top folded-in side panels are separated apart, whereby a tab is formed, and the tab is pulled to split the seal between the top ribs and then the top folded-in ribs, and then the seal is opened. The tab region half cut is simply provided, and a stopper is simply provided for prohibiting breakage of the tab. The tab is not raised until the seal is opened, so that the tab does not interfere with manufacturing the container.

20 Claims, 15 Drawing Sheets

PAPER CONTAINER AND STOPPER APPLYING APPARATUS FOR PAPER CONTAINERS

FIELD OF THE INVENTION

The present invention relates to a paper container for holding liquid, particulate matter, and the like, and more specifically relates to a stopper applying apparatus for blanks of paper containers.

BACKGROUND OF THE INVENTION

Conventionally gable-top paper containers are widely used as containers for milk, juice, and the like. The gable-top container is set up by closing the bottom of the prismatic barrel flat, and sealing the top into a gable after the container is filled with contents, such as a liquid. To open this paper container, an operation of first splitting one sealed part of the top seal, horizontally pulling the one sealed part and the other sealed part of the top seal, causing the inner seal to split open, and pulling up the folded-in sealed parts of the inner seal is needed. But seal strength of the top seal is so high that such opening operation is difficult. To facilitate the opening operation, paper containers with various extra tab members provided on one of the folded-in top panels participating in forming the opening have been proposed (e.g., Japanese Utility Model Laid-Open Publication No. 128931/1988, Japanese Utility Model Laid-Open Publication No. 66423/1990, etc.).

In the paper container of the type described in Japanese Utility Model Laid Open Publication No. 128931/1988, since a tab member is partially secured to one folded-in top panel, attachment of the tab is not easy. This is a problem. In the paper container of the type described in Japanese Utility Model Laid-Open Publication No. 66423/1990, the tab member is an obstacle to forming the container, thus causing troubles. This is a problem.

SUMMARY OF THE INVENTION

In view of these problems, the present invention was made. An object of the present invention is to provide a paper container with a gable top which is easy to manufacture and causes no trouble in being formed, and in addition is easy to open. Another object of the present invention is a stopper applying apparatus for paper containers.

A first aspect of the present invention is: a paper container made of a blank comprising: a top closed portion including a pair of top folded-in side panels (3, 4) opposed to each other, each top folded-in side panel (3, 4) having a top folded-in rib (9, 10) and slant fold lines (c) along which the top folded-in side panel (3, 4) is folded in, and a pair of top side panels (5, 6) opposed to each other, each having a top rib (7, 8), and bent inward and holding the top folded-in ribs (9, 10) of the top folded-in side panels (3, 4) between the top ribs (7, 8); four side panels below the top closed portion; and a bottom below the four side panels, wherein a tab region half cut (12) for defining a tab region (11) is formed in a substantially central part of one of the top folded-in side panels (3, 4) from the surface of the blank, the tab region having a shape a top of which is opened and a bottom of which is closed, and a stopper (14) is applied to a part near a top end of the tab region.

A second aspect of the present invention is: a paper container made of a blank comprising: a top closed portion including a pair of top folded-in side panels (3, 4) opposed to each other, each top folded-in side panel (3, 4) having a top folded-in rib (9, 10) and slant fold lines (c) along which the top folded-in side panel (3, 4) is folded in, and a pair of top side panels (5, 6) opposed to each other, each having top rib (7, 8), and bent inward and holding the top folded-in ribs (5, 6) of the top folded-in side panels (3, 4) between the top ribs (7, 8); four side panels below the top closed portion; and a bottom below the four side panels, wherein a stopper (14) is applied to a substantially central part of one of the top folded-in side panels, (3, 4) and a tab region half cut for defining a tab region is formed from a surface layer of the stopper, the tab region having a shape a top of which is opened and a bottom of which is closed.

A third aspect of the present invention is: a stopper applying apparatus for applying a stopper for a tab to one of a pair of top folded-in side panels (3, 4) to be folded in of a blank for a paper container, the apparatus comprising: tape feed means for feeding a plastic tape for the stopper; a suction roll having a first sucking portion for sucking the plastic tape fed by the tape feed means; a cutter roll for cutting the plastic tape sucked on the first sucking portion of the sucking roll by a desired required length in cooperation with the sucking roll so as to form the stopper; press-application means including a press-application surface, a second sucking portion for receiving and sucking the stopper from the first sucking portion of the sucking roll, and heating means for heating the stopper sucked on the second sucking portion; and conveying means for conveying the blank for a paper container to the press-application means, the stopper being press-applied by the press-application surface of the press-application means to the blank for a paper container conveyed by the conveying means.

According to the first and the second aspect of the present invention, the seal of one pair of top ribs is horizontally split open, and then the lower end of the tab region is pulled up to form a tab. The tab is pulled, whereby the seal between the top ribs and top folded-in ribs is split open. In this case, the stopper functions as stopping delamination of the tab and preventing breakage of the tab.

According to the third aspect of the present invention, a plastic tape is fed by the tape feed means, and the plastic tape is sucked on the first sucking portion of the suction roll. The plastic tape sucked on the first sucking portion is cut to a desired length to become a stopper by the cutter roll in cooperation with the suction roll. The stopper is conveyed from the first sucking portion of the suction roll to the second sucking portion of the press-application means, and is heated while being sucked on the second sucking portion. The stopper sucked on the second sucking portion of the press-application means is press-applied to a blank of a paper container which is conveyed by the conveying means.

BRIEF DESCRIPTION OF THE DRAWINGS

FIG. 4 is a perspective view of the paper container with the tab formed on.

PREFERRED EMBODIMENTS OF THE INVENTION

Embodiments of the present invention will be explained with reference to the drawings attached hereto. First the paper container will be explained with reference to FIGS. 1 to 16.

Figure 1:
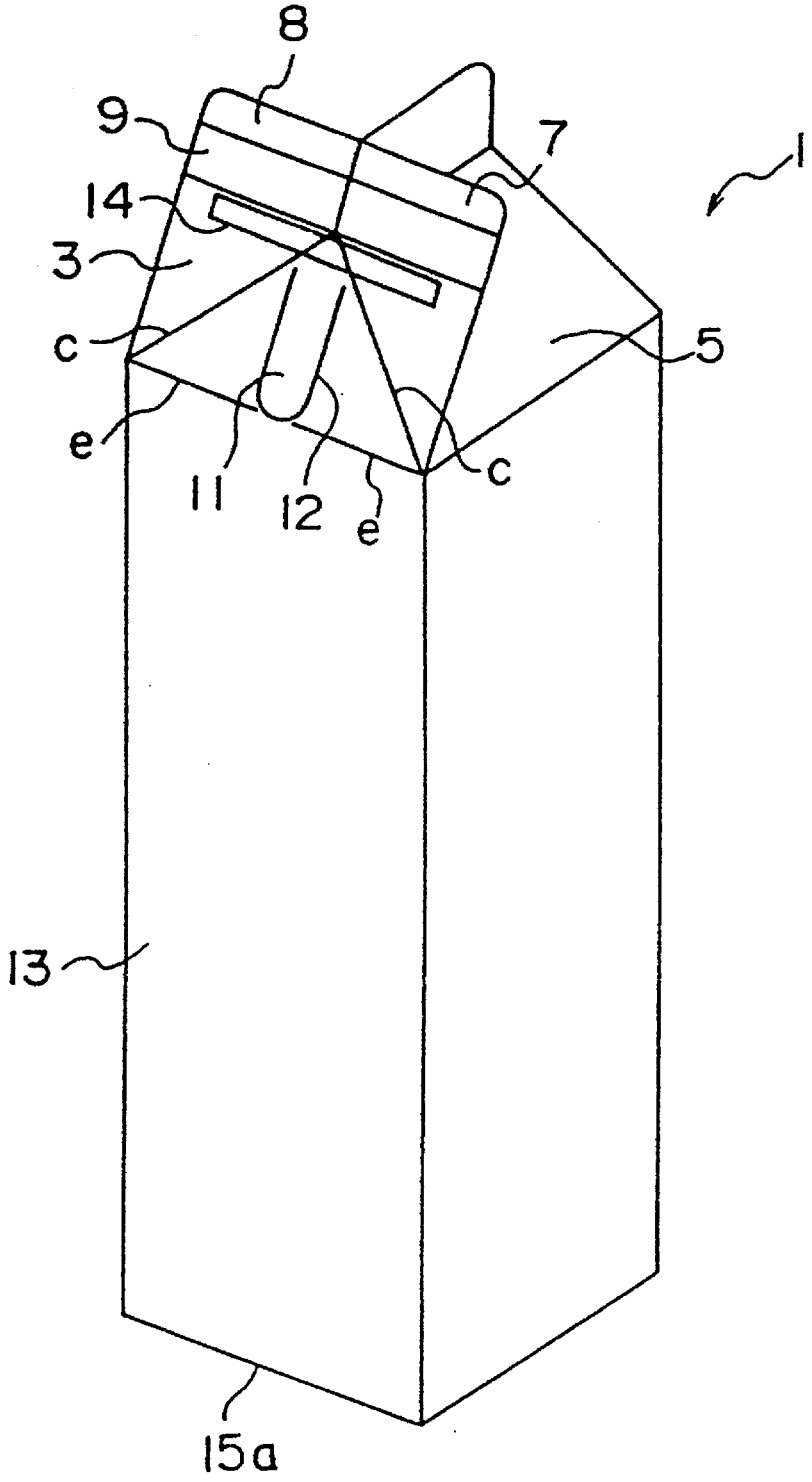
FIG. 1 is a perspective view of the paper container according to an embodiment of the present invention.

FIG. 1 is a perspective view of the paper container according to one embodiment of the present invention. The container 1 is formed by setting up the blank 2 shown in the development of FIG. 2 in the known procedure. That is, the blank 2 is folded flat along vertical fold lines a, b, and adhering a flap of a part A to an opposed overlap part B. Then the laid-flat blank 2 is set up into a quadratic prism by a loading machine, and the bottom of the blank 2 is closed flat to close a bottom 15*a* of the container 1. Then, the container 1 in this state is filled with a liquid. Then top folded-in panels 3, 4 opposed to each other are folded in along their associated slant fold lines c, d to be near to each other. Next, rest top panels 5, 6 opposed to each other are folded inward so that top ribs 7, 8 of the top panels 5,6 sandwich top folded-in ribs 9, 10 of the folded-in top panels 3, 4, which have been folded in near to each other, in a four-sheet overlap form. Then the insides of the overlapped top ribs 7, 8 are adhered to each other to seal the top of the container into a gable. A top closed portion of the container 1 is thus formed.

The paper container according to this embodiment contains milk or juice. The blank 2 to be set up into the paper container 1 is formed by pressing a packaging material comprising a paper layer having both sides laminated with polyethylene film.

In this case, the blank 2 comprises, from the outside to the inside, e.g., a polyethylene film 15 μ/a paper layer 340 g/m$^2$/a polyethylene film 35–40 μ.

Figure 3:
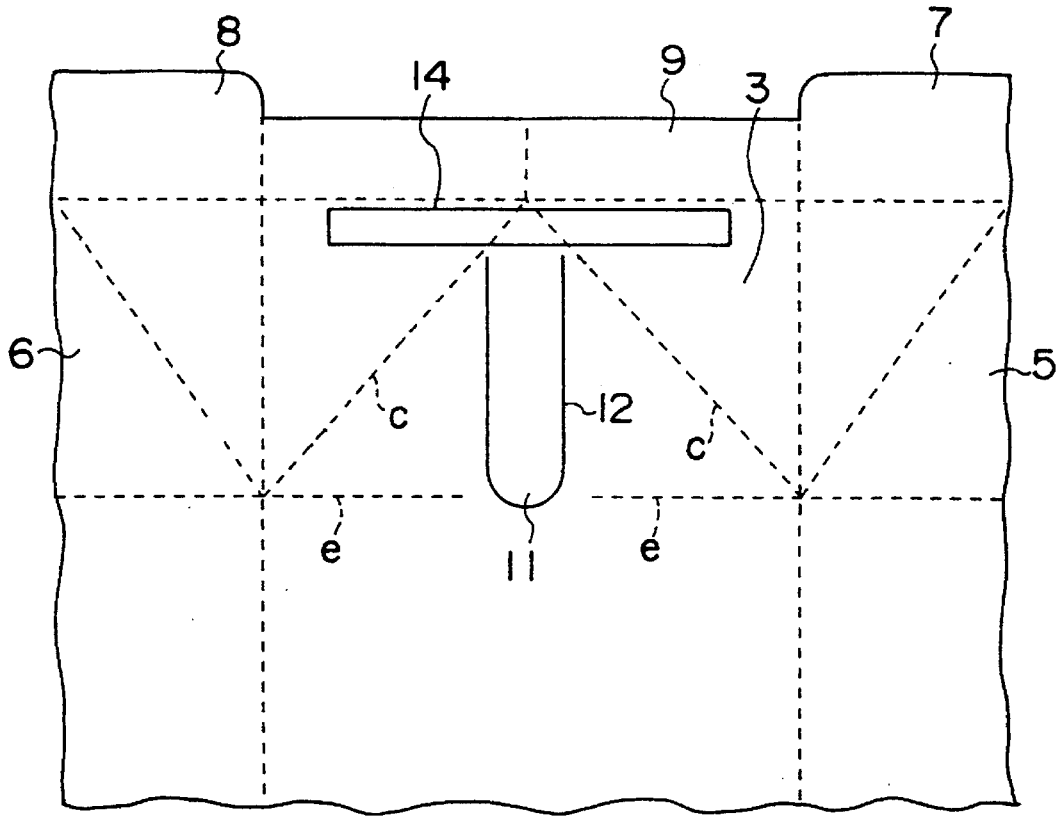
FIG. 3 is an enlarged partial view of FIG. 2.
Figure 4:
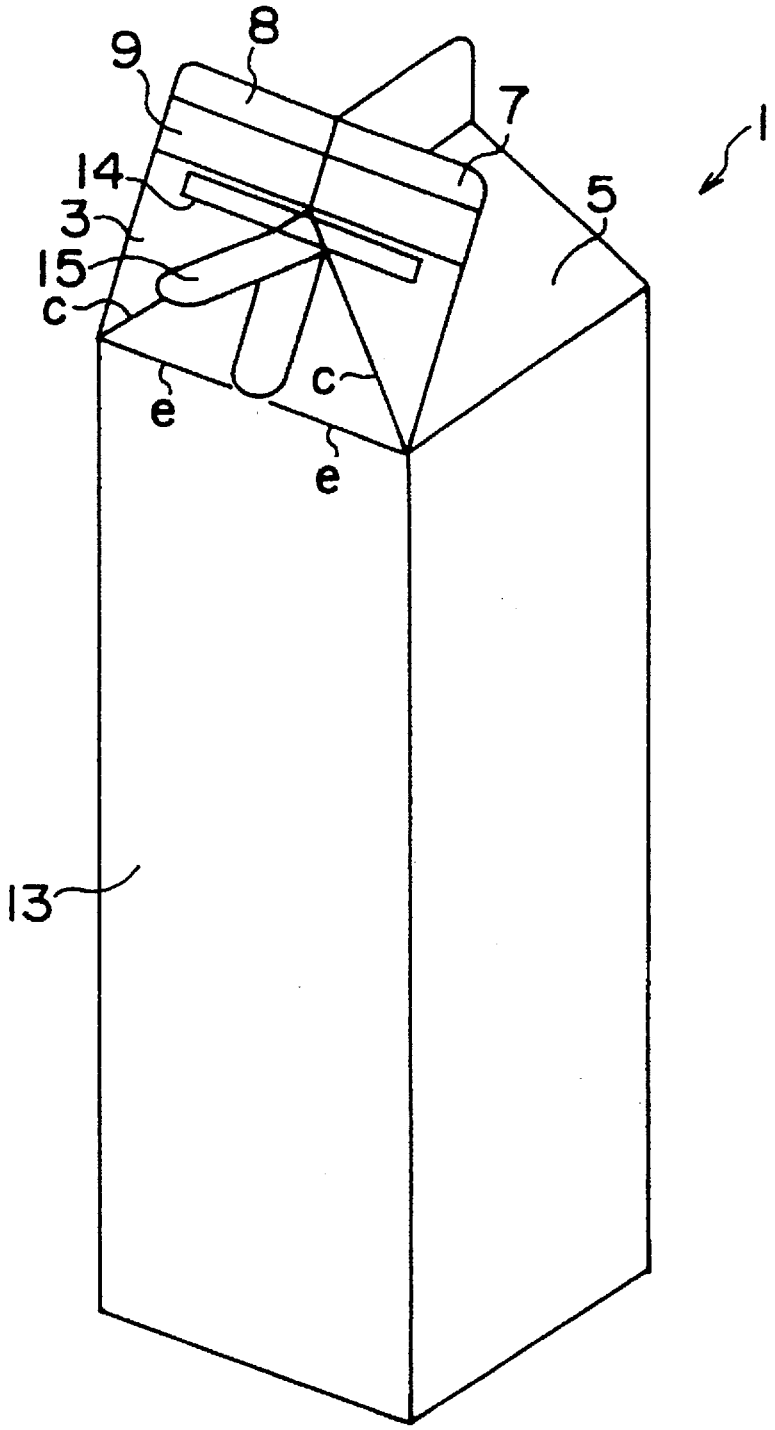
Figure 5:
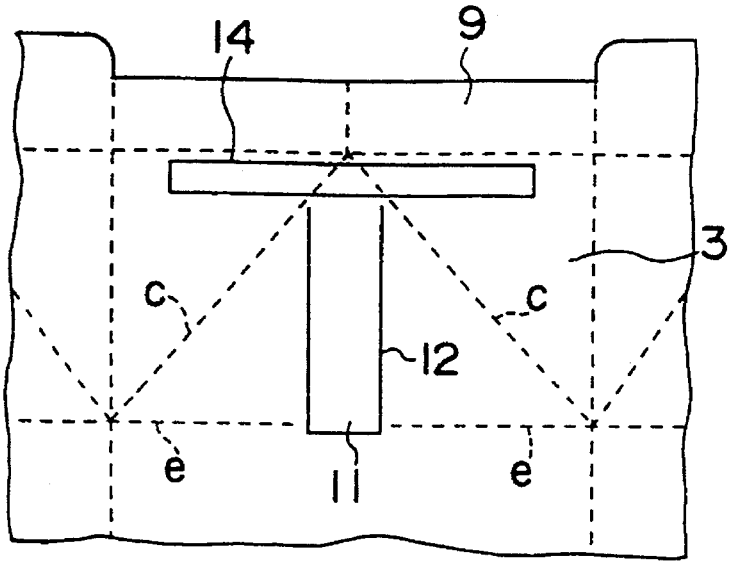
FIG. 5 is a plan view of another example of the tab region.
Figure 6:
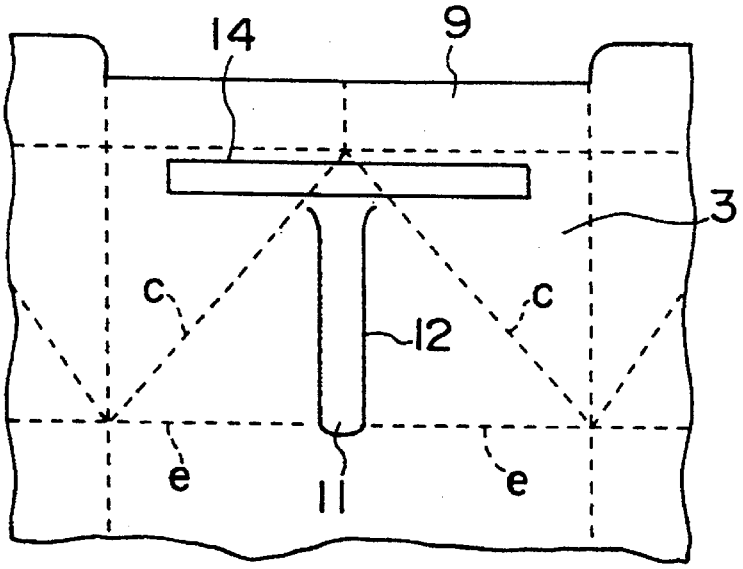
FIG. 6 is a plan view of another example of the tab region.
Figure 7:
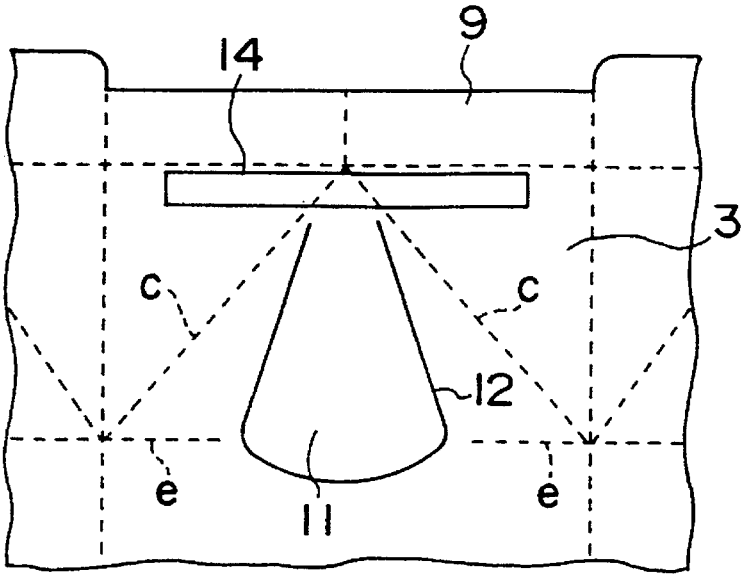
FIG. 7 is a plan view of another example of the tab region.
Figure 8:
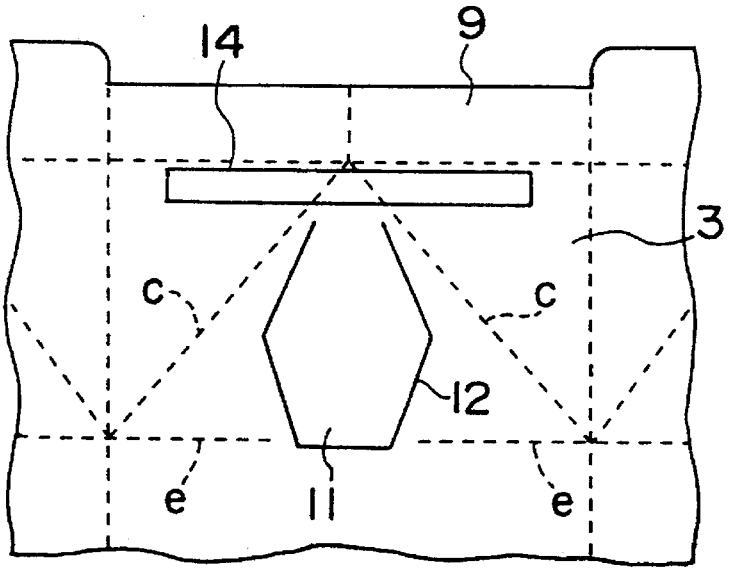
FIG. 8 is a plan view of another example of the tab region.
Figure 9:
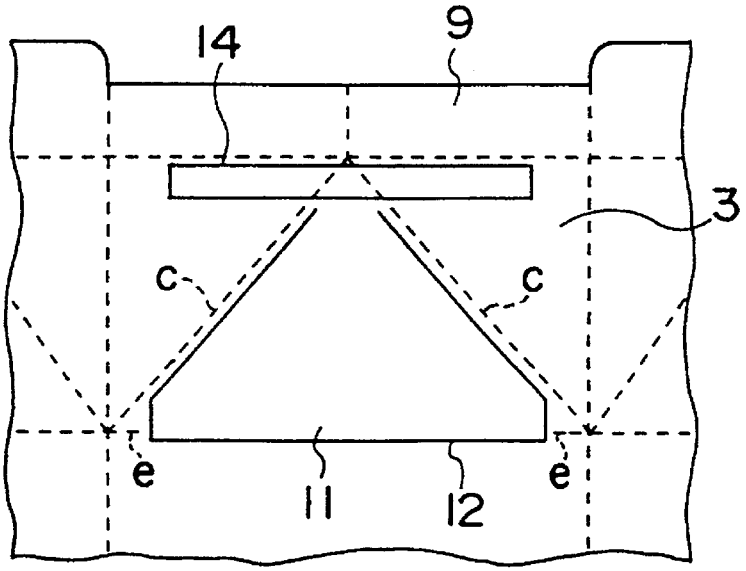
FIG. 9 is a plan view of another example of the tab region.

When blanked, fold lines for setting up the blank 2 are formed, and, as shown enlarged in FIG. 3, a half cut (tab region half cut) 12 is formed from the outside in the central part of the top folded-in side panel 3 to be folded in with a distance from the top folded-in rib 9 to be folded in for defining a vertical U-shaped tab region 11. The half cut 12 is formed in a depth which passes through the exterior polyethylene film and reaches the thickness-wise middle part of the paper layer. The half cut 12 my be formed in the final unit of a printing machine for printing patterns on a packaging material. In this embodiment the tab region 11 is located between two slant fold lines c on the top folded-in side panel 3 to be folded in and has the bottom thereof located on the boundary between the top folded-in side panel 3 and a side panel 13 below the top folded-in side panel 3. A fold line on the boundary between the top folded-in side panel 3 to be folded in, and the side panel 13 is formed so as not to interfere with a lower part of the tab region 11. Following this press of the blank 2, the stopper 14 in a form of a polyethylene film strip of, e.g., a 100–120 μ-thickness is heat sealed onto the outside layer (the polyethylene film) of the blank 2 between the upper end of the tab region 11 and the top folded-in rib 9. For effective sealing, the part for the stopper 14 to be sealed onto may not be printed. The thus-prepared blank 2 is set up into the paper container 1. A thickness of the stopper 14 is preferably 6–8 times the thickness of the exterior polyethylene film of the blank 2.

Figure 15:
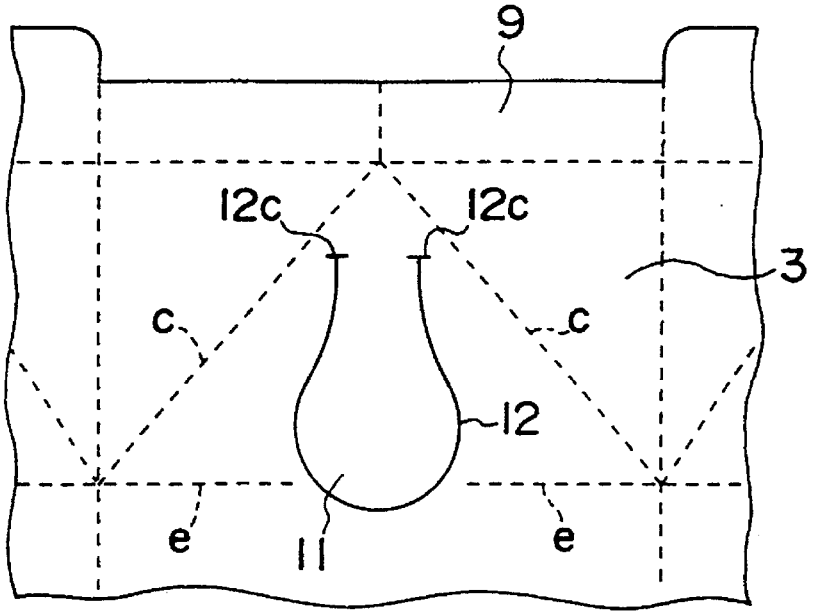
FIG. 15 is a plan view of another example of the tab region.

To open the paper container 1, the part of a top seal between the top ribs 7, 8 on the side of the tab region 11 is split as shown in FIG. 1, the top fold-in side panel 3 is horizontally pulled open, and then the tab region 11 is pulled up from the lower end to delaminate the paper layer into a tab 15 as shown in FIG. 15. In this case, the top folded-in side panel 3 is bent inward along the fold line e, making the lower end of the tab region 11 slightly loose. The loose lower end of the tab region 11 can be picked to pull the tab region 11 upward to form the tab 15. The tab 15 is continuously pulled upward, and the delamination of the paper layer comes to a stop at the stopper 14. Then a top end of the top folded-in side panel 3 is pulled outward together with the stopper 14, whereby the part of the top seal between the top ribs 7, 8, and the top folded-in rib 9 is split, and the top folded-in rib 9 is pulled up. Thus, an opening of the container 1 is defined.

The tab region 11 defined by the half cut 12 is not limited to the simple U-shape in the above-described embodiment, and may have any shape as exemplified in FIGS. 5 to 9 as long as a shape has a closed lower end and an open upper end and can be split off from the lower end. The tab region 11 of FIG. 5 has a U shape having a horizontally straight lower end. The tab region 11 of FIG. 6 has a U shape having outwardly expanded upper ends. The tab region 11 of FIG. 7 has a U shape having an expanded lower end. The tab region 11 of FIG. 8 has a U shape having the middle part bulged outward. The tab region 11 of FIG. 9 covers substantially all the part defined by the two slant fold lines c on the topfolded-in side panel 3.

To facilitate pickup of the tab region 11, as in the above-described embodiment, the lower end of the tab region 11 is located below the boundary of the top folded-in side panel 3 and the side panel 13, specifically 2–10 mm below the fold line e, more preferably 2–5 mm below the fold line e. Although not shown, the fold line e on the boundary between the top folded-in side panel 3 and the side panel 13 may be in the tab region 11.

The stopper 14 provided horizontally on the upper end of the tab region 11 is not limited to polyethylene film strip as in the above-described embodiment. In addition to the polyethylene film strip, strips of arbitrary thermoplastic resin films, and strips having a thermoplastic resin film laminated at least on the sealing sides (e.g., laminated films, such as PE/PET, PE/NY/OPP, etc.) may be used. Means for providing these strips on the top side panel 3 is not limited to the above-described heat seal, and ultrasonic seal, high-frequency seal, etc. may be used. Instead, adhesive tapes, e.g., an adhesive/PE. and an adhesive/PET, an adhesive/OP, etc. may be adhered to the top folded-in side panel 3. Instead, fibrous materials, such as a string, etc., strong sheets of paper, etc. may be hot melted or glued. It is also possible only to apply a hot melt material in a strip.

Figure 10:
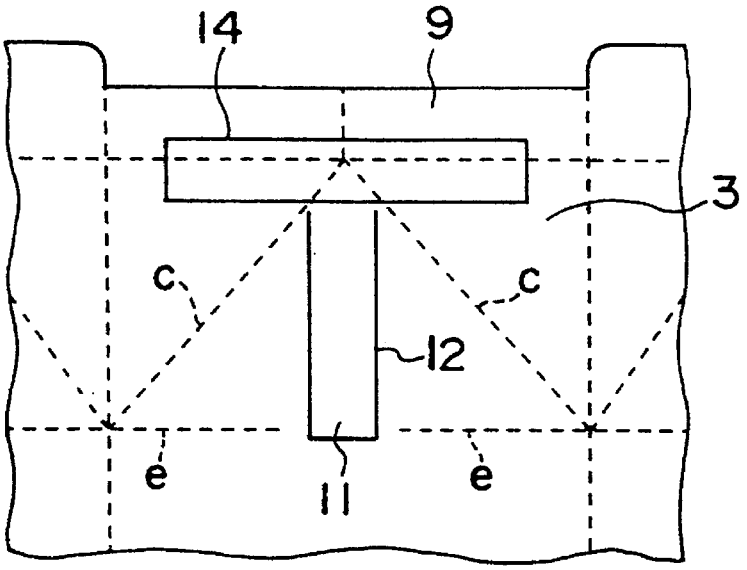
FIG. 10 is a plan view explaining an example of another stopper location.

In the above-described embodiment, to prevent the tab 15 from breaking off, the stopper 14 is provided between the upper end of the tab region 11 and the top folded-in rib 9, but as exemplified in FIG. 10, the stopper 14 may be over the top folded-in rib 9. It makes no difference as to whether or not the stopper 14 is extended over the upper end of the tab region 11, and the stopper 14 may be formed in any shape. In cases that the stopper 14 covers the upper end of the half cut 12, and the stopper 14 is provided in the top folded-in rib 9, no space may be provided between the tab region 11 and the top folded-in rib 9.

Figure 11:
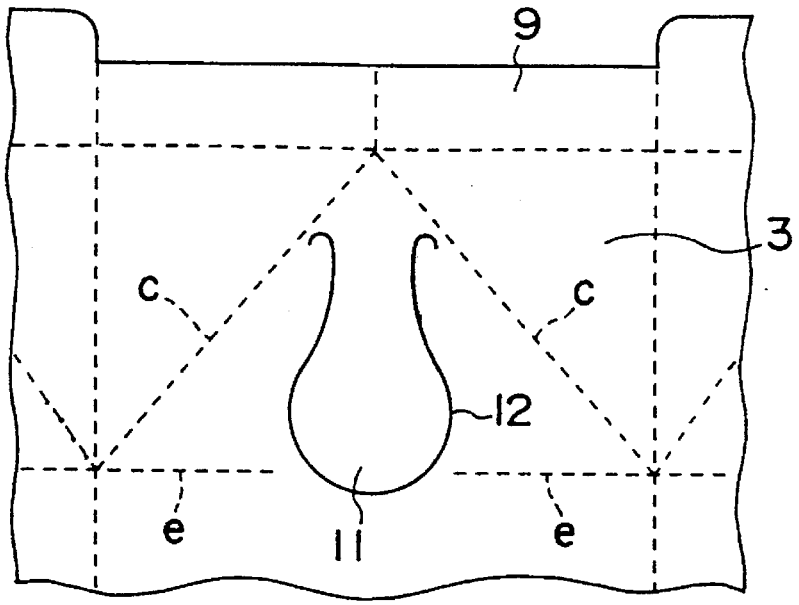
FIG. 11 is a plan view of another example of the tab region.
Figure 12:
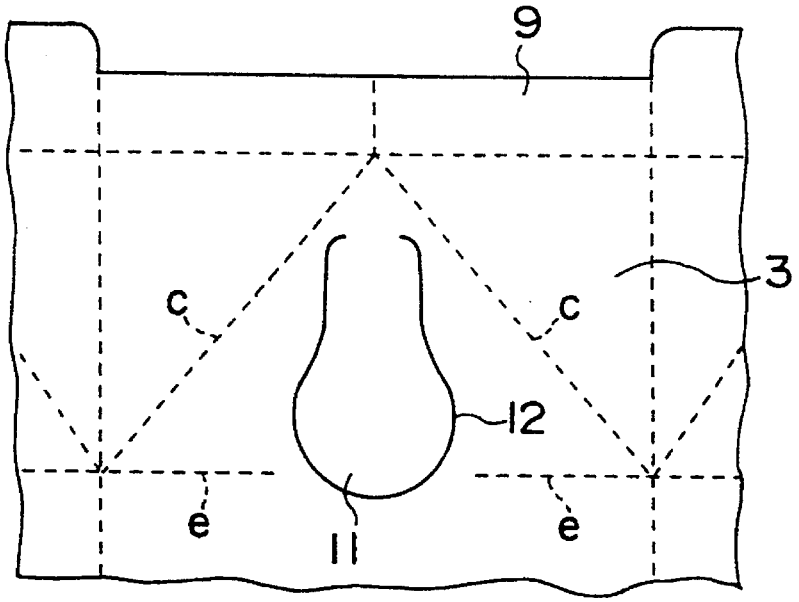
FIG. 12 is a plan view of another example of the tab region.
Figure 13:
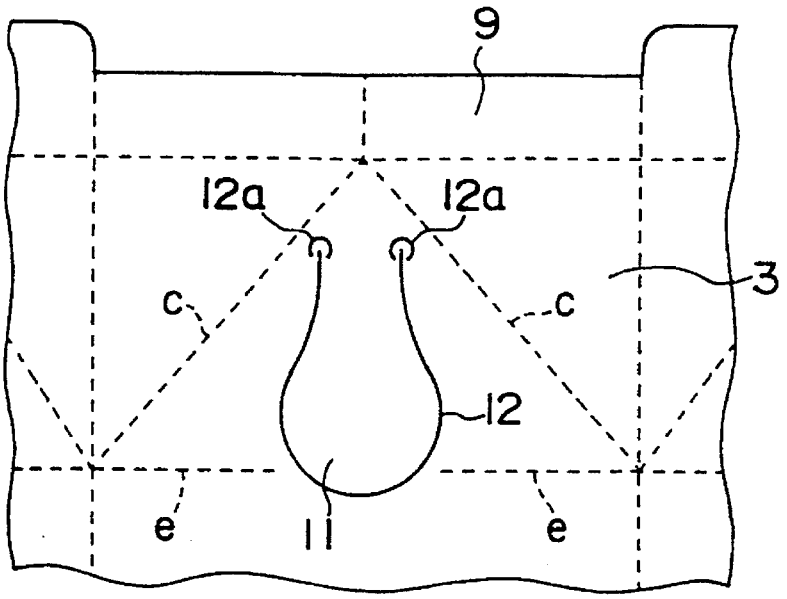
FIG. 13 is a plan view of another example of the tab region.
Figure 14:
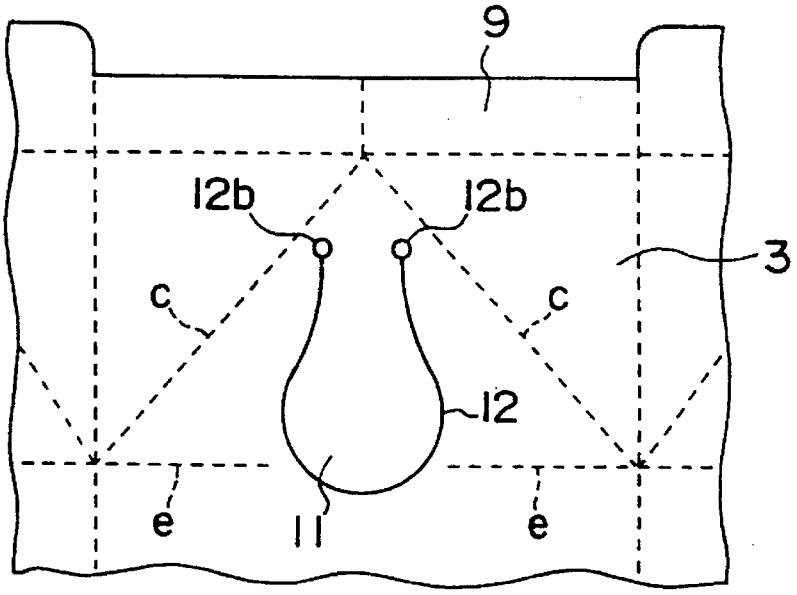
FIG. 14 is a plan view of another example of the tab region.
Figure 16:
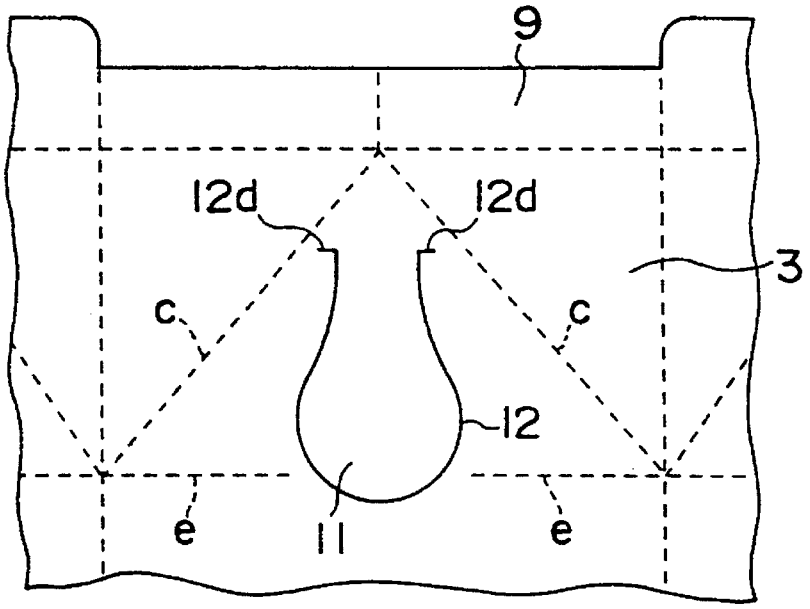
FIG. 16 is a plan view of another example of the tab region.

In the above-described embodiment, the tab 15 into which the tab region 11 is split off from the lower end is hindered by the stopper 14 from breaking off. The tab 15 can be more securely hindered from breaking off and be more effective to open the container by providing a device for prohibiting run of the split on the upper end of the half cut (tab region half cut) 12 as in FIGS. 11–16. In FIG. 11, outward arcs are provided at the upper ends of the half cut 12. In FIG. 12, inward arcs are provided at the upper ends of the half cut 12. In FIG. 13, arcuate half cuts 12*a* surround the upper ends of the half cut 12. In FIG. 14, the upper ends of the half cut 12 are terminated in small-circular half cuts 12*b*. In FIG. 15, the upper ends of the half cut 12 are terminated in a half cuts 12*c* horizontally extended on the inside and the outside of the half cut 12. In FIG. 16, the upper ends of the half cut 12 are terminated in a half cuts 12*d* horizontally extending only on the outside of the half cut 12. FIG. 11–16 shows the states before the stopper is provided.

In the case that the paper container 1 is for containing milk or juice, a packaging material comprising a paper layer having both sides laminated with polyethylene film (PE/paper/PE) is preferably used, but depending on contents of the container, packaging materials 1)–6) of the laminated structure exemplified below are suitably used.

1) [PE/paper/PE/(PE/PVDC/PE)]
2) [PE/paper/PE/adhesive/PET]
3) [PE/paper/PE/aluminium foil/PET/PE]
4) [PE/paper/PE/silicon or silicon oxide[$Si_xO_y$(x=1, 2:Y=0,1,2,3)-vapour deposited PET/PE]
5) [PE/paper/PE/K-PET/PE]
6) [PE/paper/PE/barrier layer/PET/LDPE or LLDPE] (barrier layer: EVOH, ON, K-OP, HDPE, OPP)

In these packaging materials, a depth of the half cut 12 defining the tab region 11 is preferably from immediately above the paper layer to the innermost resin film to delaminate the paper layer in the tab region. To ensure the delamination, it is preferred that the half cut 12 is deep down to about ½–⅔ of a thickness of the paper layer. The half cut 12 may be formed in, e.g, interrupted sewing machine stitches except the lower part thereof to be picked by fingers, or in interrupted sewing machine stitches. It is needless to say that in the latter case, an interval of interrupted stitches is so set that the half cuts 12 are interrupted to enable delamination of the paper layer.

The above-described embodiment has been explained by means of the prismatic paper container, but the present invention is applicable to paper containers whose barrels and bottoms are in arbitrary shapes as long as the containers have gabel top portions.

Figure 24:
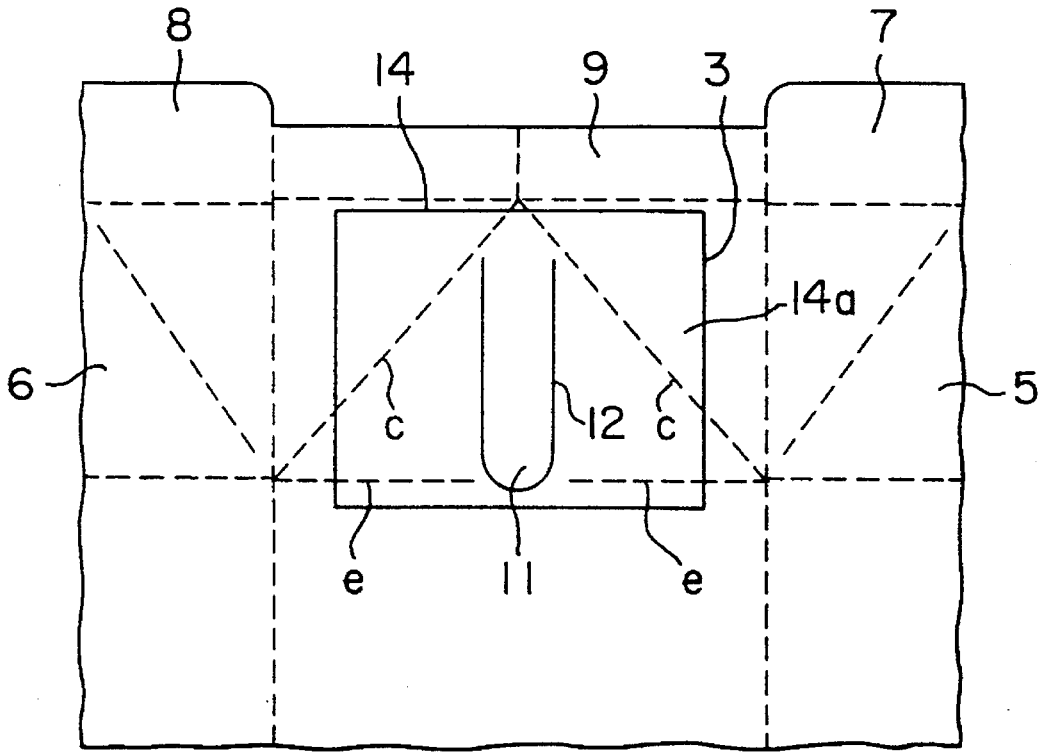
FIG. 24 is a view of a top folded-in side panel to be folded in with a stopper applied to the entire central part thereof.

In the above-described embodiment, the blank 2 has the stopper 14 between the upper end of the tab region 11 and the top folded-in rib 9 in (FIG. 3), but this is not essential. For example, as shown in FIG. 24, a stopper 14*a* may be provided on the substantially entire central part of the top folded-in side panel 3, and the lower end of the stopper 14*a* may be extended to below the fold line c. In this case, the half cut 12 is formed from the exterior to the interior and defines the tab region 11.

Then, a method for providing the stopper 14*a* and a method for forming the half cut 12 will be explained. First, a material having a laminated structure of, a polyethylene film 15 μ/a paper layer 340 g/m$^2$/a polyethylene film 35–40 μ from the exterior is pressed into the blank 2. The necessary fold lines a, b, c, d, e are concurrently formed. Then as shown in FIG. 24, the stopper 14*a* of, e.g., a 100–120 μ-thickness polyethylene film strip is heat sealed to the outside layer (the polyethylene film) of the blank 1. A part of the blank 2 where the stopper 14*a* is to be sealed is left not printed to make the sealing effective. Then the half cut 12 is formed from the exterior of the stopper 14*a* down to substantially the thickness-wise middle of the paper layer. This half cut 12 defines the tab region 11.

In FIG. 24, the stopper 14*a* functions not only as a stopper for the tab 15 formed by pulling the tab region 11, but also as a reinforcement for the tab 15.

Thus, the tab 15 can be strongly pulled even if an anti-heat seal material is not applied to the inside layer of the top folded-in rib 9, and therefore the container 1 is easily opened.

The half cut 12 may be formed in the stopper 14*a* in the shapes as shown in FIGS. 5 to 12. The arcuate half cut 12*a*, the small circular half cut 12*b*, and horizontal half cuts 12*c*, 12*d* of FIGS. 13 to 16 may be formed in the stopper 14*a*.

As described above, in the paper container according to the present invention, the tab region 11 is delaminated in the paper layer into the tab 15, and the tab 15 is further pulled to tear the inner seal of the top seal of the container, whereby the operation for erecting the top portion of the container 1 is easy. In addition, the half cut 12 defining the tab region 11 is simply provided, and only the stopper 14 for prohibiting split-off of the tab 15 is provided, and therefore the manufacture of the container, becomes simpler. Furthermore, the tab 15 is not raised until the container 1 is opened, and therefore the tab does not get in the way of setting up the blank into the container.

Next a stopper applying apparatus for a paper container for applying a stopper to a blank will be explained with reference to FIGS. 17 to 22.

Figure 17:
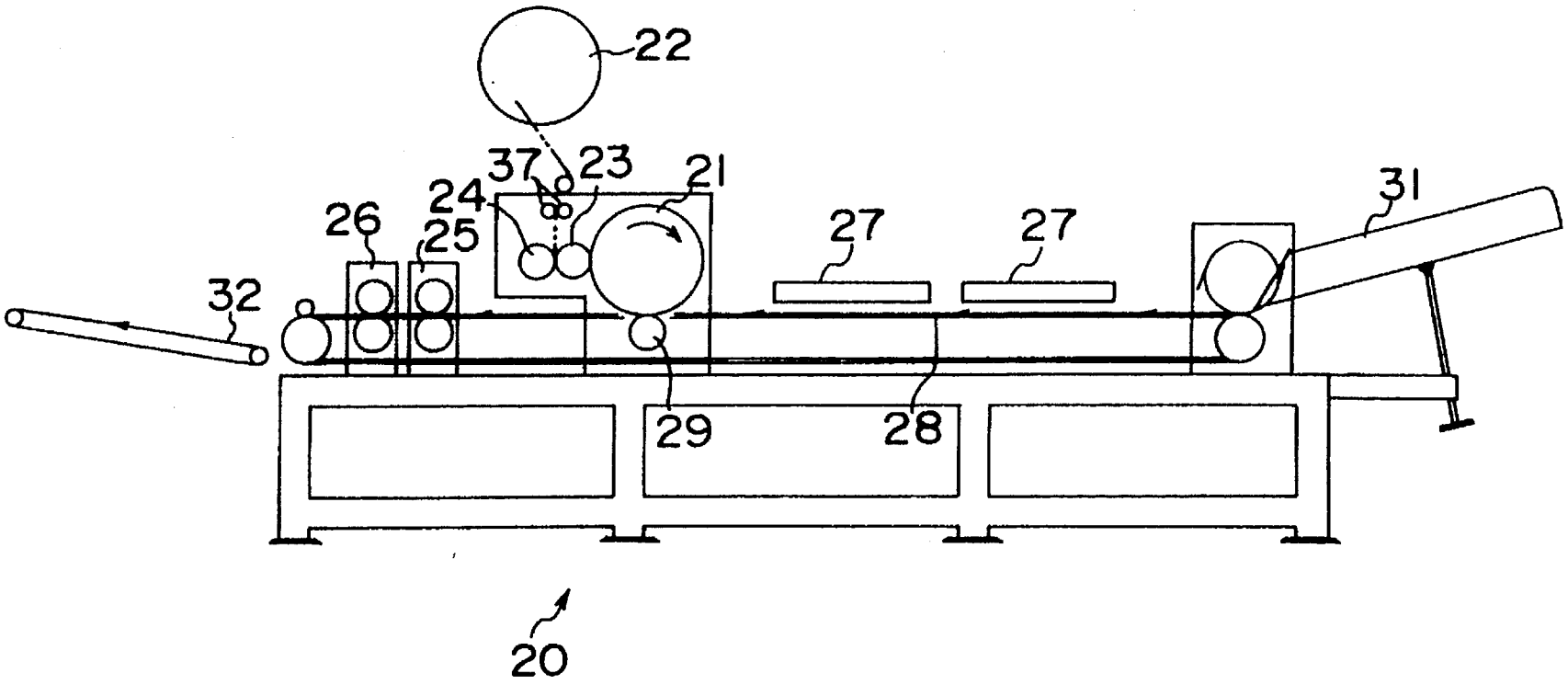
FIG. 17 is a diagrammatic view of the stopper application apparatus according to the present invention.
Figure 18:
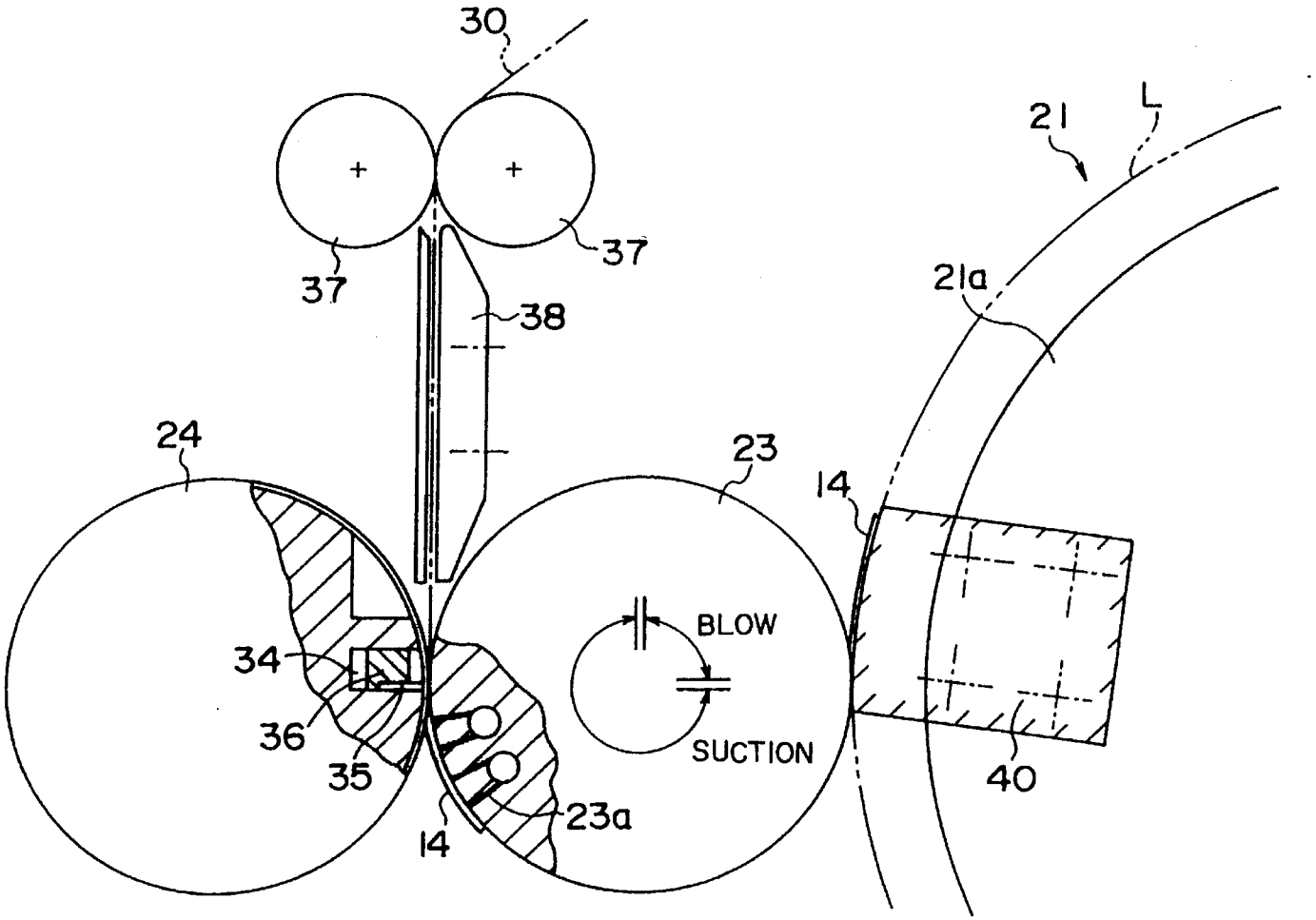
FIG. 18 is an enlarged view of the suction roll, cutter roll and the press-application means.

With reference to FIGS. 17 and 18 the stopper applying apparatus will be generally explained. The stopper applying apparatus 20 is for applying the stoppers 14, 14*a* to the blank 2 of the paper container.

That is, the stopper applying apparatus 20 applies the stopper 14 to the upper end of the tab region 11 (FIG. 3), and applies the stopper 14*a* to the substantially central part of the top folded-in side panel 3 (FIG. 24). But here the case where the stopper 14 is applied to the upper end of the tab region 11 is described. The stopper 14*a* can be applied in the same way to the substantially central part of the top folded-in side panel 3.

As shown in FIG. 17, the stopper applying apparatus 20 comprises a top feeder 31 for continuously feeding blanks 2, conveying means for conveying the blanks 2 fed from the top feeder 31, and a near infrared radiation heater 27 for heating stopper application parts on the blanks 2 conveyed by the conveying means 28. Downstream of the near infrared radiation heater 27, there are provided press-application means 21 for press-applying the stoppers to the stopper application parts on the blanks 2, and a nip roll 29.

As shown in FIGS. 17 and 18, tape feed means 22 for continuously feeding a plastic tape 30 for the stoppers is provided above the press-application means 21. Below the tape feed means 22, there is provided a suction roll 23 with suction holes 23*a* formed in for sucking the plastic tape 30 fed from the tape feed means 22. Between the tape feed means 22 and the suction roll 23 there are provided pinch rolls 37, 37 for conveying the plastic tape 30 therebetween, and a tape guide 38 for guiding the plastic tape 30 in the stated order.

A cutter roll 24 is provided near the suction roll 23 for cutting the plastic tape 30 in cooperation with the suction roll 23. A cutter 35 is projected from the outer circumferential surface of the cutter roll 24 for contacting the outer circumferential surface of the suction roll 23 to cut the plastic tape 30 in a desired length. The cut plastic tape become a stopper 14.

The cutter 35 is disposed displaceably in an accommodation groove 34 of the cutter roll 24, and a projected height of the cutter 35 is adjusted by sliding a height adjustment block 36 in the accommodation groove 34.

The press-application means 21 is located opposite to the cutter roll 24 with respect to the suction roll 23. The suction holes 23*a* function to suck over a ¾ rotation of the suction roll 23 on the side of the curer roll 24, and over the rest ¼ rotation the suction holes 23*a* function to blow air (see FIG. 18).

The press-application means 21 has a disc-shaped support 21*a*, and three press-application heads 40 secured on the side of the outer peripheral part of the disc-shaped support 21*a*. The outer surfaces of the three press-application heads 30 are moved along an orbit L in FIG. 18. The orbit L shown has a diameter three times that of the suction roll 23.

Then the press-application heads 40 of the press-application means 21 will be detailed with reference to FIGS. 19 to 23. Each press-head 40 has a Teflon-coated press-application surface 40a for press-applying a stopper 14 to a blank 2 in cooperation with the nip roll 29. A number of suction holes 41 are provided in the press-application surface 40*a*.

Figure 19:
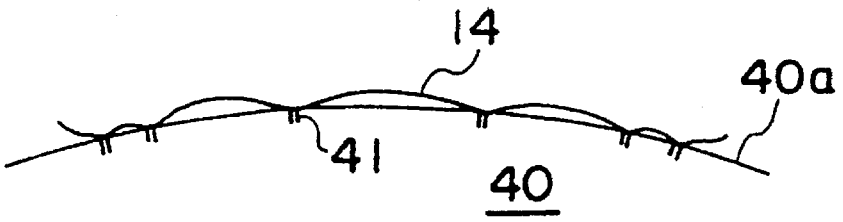
FIG. 19 is a side view of the press-application head of the press-application means.
Figure 20:
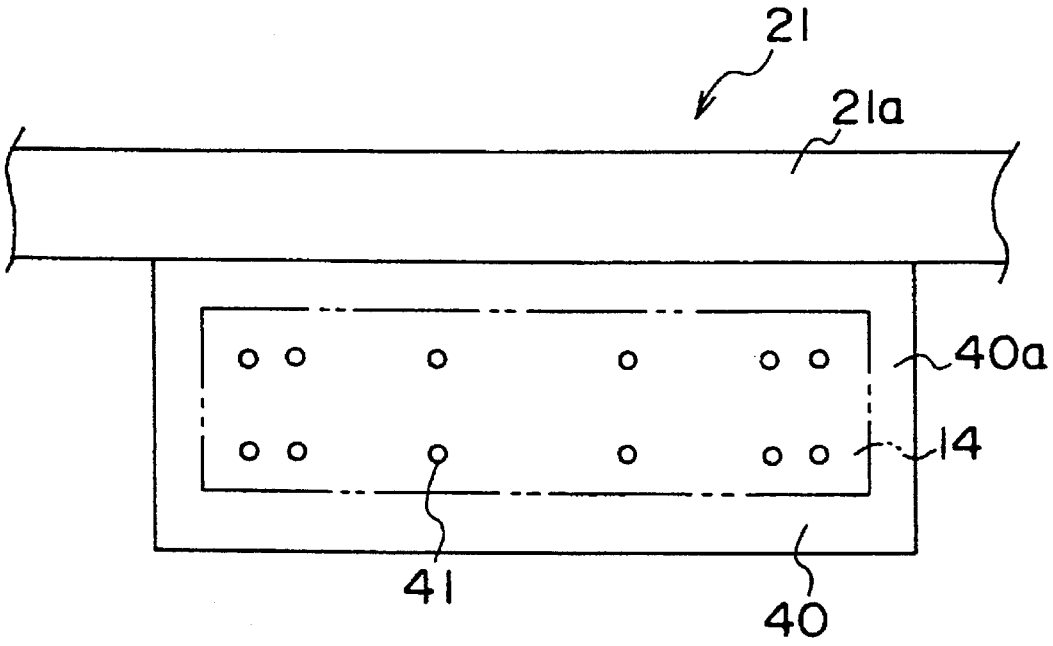
FIG. 20 is a plan view of the press-application head of the press-application means.
Figure 21:
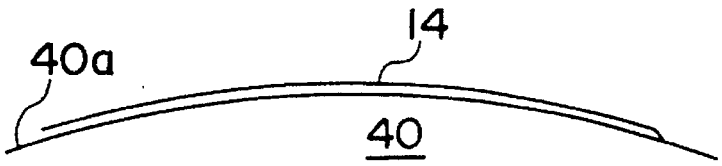
FIG. 21 is a side view of the press-application head of the press-application means.
Figure 22:
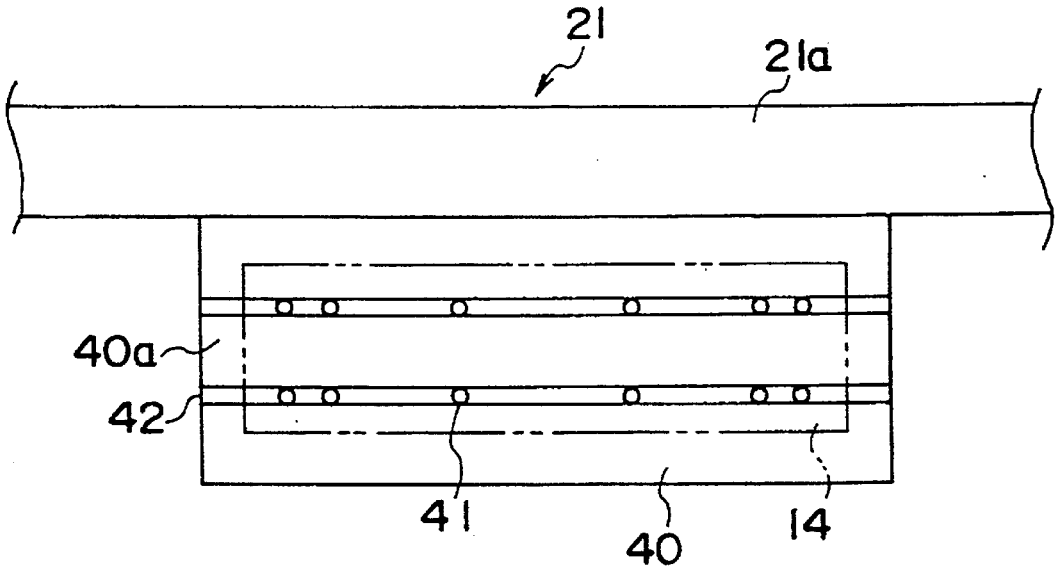
FIG. 22 is a plan view of the press-application head of the press-application means.

As shown in FIGS. 19 and 20, the suction holes 41 are arranged in two linear lines in the press-application surface 40*a*. As shown in FIGS. 21 and 22, communication grooves 42 may be provided in the press-application surface 40*a* for interconnecting the suction holes 41. As shown in FIGS. 21 and 22, the communication grooves 42 enable the stopper 14 to be sucked over a large area along the communication holes 42, whereby stoppers 14 are free from being partially sucked to be deformed, and can be held flat.

Figure 23:
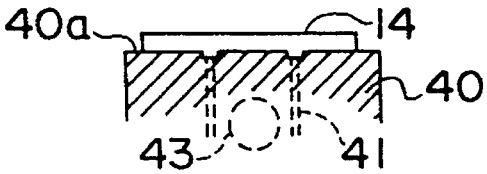
FIG. 23 is a sectional view of the press-application head of the press-application means.

As shown in FIG. 23, each press-application head 40 has heating means 43 built in for heating the stopper 14 sucked on the press-application surface 40*a*. The heating means 3 heat the press-application surface 40*a* up to about 150°–250 ° C.

As shown in FIG. 17, downstream of the press-application means 21 there are provided heating rolls 25 for heating the stopper 14 applied to the blank 2, and cooling rolls 26 for cooling the stopper 14 applied to the blank 2 in the stated order. As shown in FIG. 17, discharge means 32 is provided downstream of the cooling rolls 26 for discharging blanks 2 with stoppers 14 applied thereto.

Next, an operation of the stopper applying apparatus will be explained. A blank 2 fed from the top feeder 31 is conveyed by the conveying means 28 toward the press-application means 21. While the blank 2 is being conveyed by the conveying means 28, the stopper application part on the blank 2 is preheated by the near infrared radiation heater 27.

The near infrared radiation heater 27 irradiates a infrared radiation having a wavelength of 0.8–2.0 μ and can heat only the exterior layer (polyethylene film) of the blank 2. In the case that a far infrared radiation heater, which heats water, is used, the exterior layer of a blank 2 is heated after the paper layer thereof has been heated, whereby the blank 2 will be generally heated and deformed. On the other hand, the near infrared radiation 27 can heat only the exterior surface of a blank 2.

Then, the blank 2 is conveyed toward the press-application means 21. While the blank 2 is being conveyed, the plastic tape 30 is continuously fed from the tape feed means 22 and passes through the pinch rolls 27, 27 and the tape guide 38 and then goes between the suction roll 23 and the cutter roll 24.

When the plastic tape 30 reaches the suction holes 23*a* of the suction roll 23 as shown in FIG. 18, the plastic tape 30 is sucked by the suction holes 23*a* and held sucked on the suction roll 23. Then, the cutter 35 of the cutter roll 24 abuts on the outer surface 23 of the suction roll 23, cutting the plastic tape 30 by a desired length to form the stopper 14.

The stopper 14 held sucked on the suction roll 23 is conveyed toward the press-application means 21 and is transferred onto the press-application head 40 of the press-application means 21. During the ¾ rotation of the suction roll 23, the suction holes 23*a* suck the stopper 14, and blow air during a ¼ rotation thereof, whereby the suction roll 23 can transfer the stopper 14 onto the press-application head 40 without failure when the suction holes 23*a* reach the press-application head 40.

The stoppers 14 are thus transferred one after another onto each press-application head 40 because the orbit L along which the outer circumference of the press-application head 40 travels is three times a diameter of the suction roll 23.

The stopper 14 transferred onto the press-application head 40 is held on the press-application surface 40*a* of the press-application head 40, sucked by the suction holes 41 of the press-application head 40. As shown in FIG. 17, the stopper 14 held on the press-application head 40 of the press-application means 21 arrives at the nip roll 29, while the press-application head 40 has made a ¾ rotation. Thus, while the press-application is making a ¾ rotation, the stopper 14 is heated by the heating means 43 in the press-application head 40 and subsequently press-applied to the stopper application part on the blank 2 between the nip roll 29 and the press-application head 40.

The suction holes 41 of the press-application head 40 incessantly suck the stopper 14, but the stopper 14 can be transferred onto the blank 2 without failure by the press-application head 40 because an application force between the blank 2 and the stopper 14 is larger than a sucking force of the suction holes 41.

Figure 2:
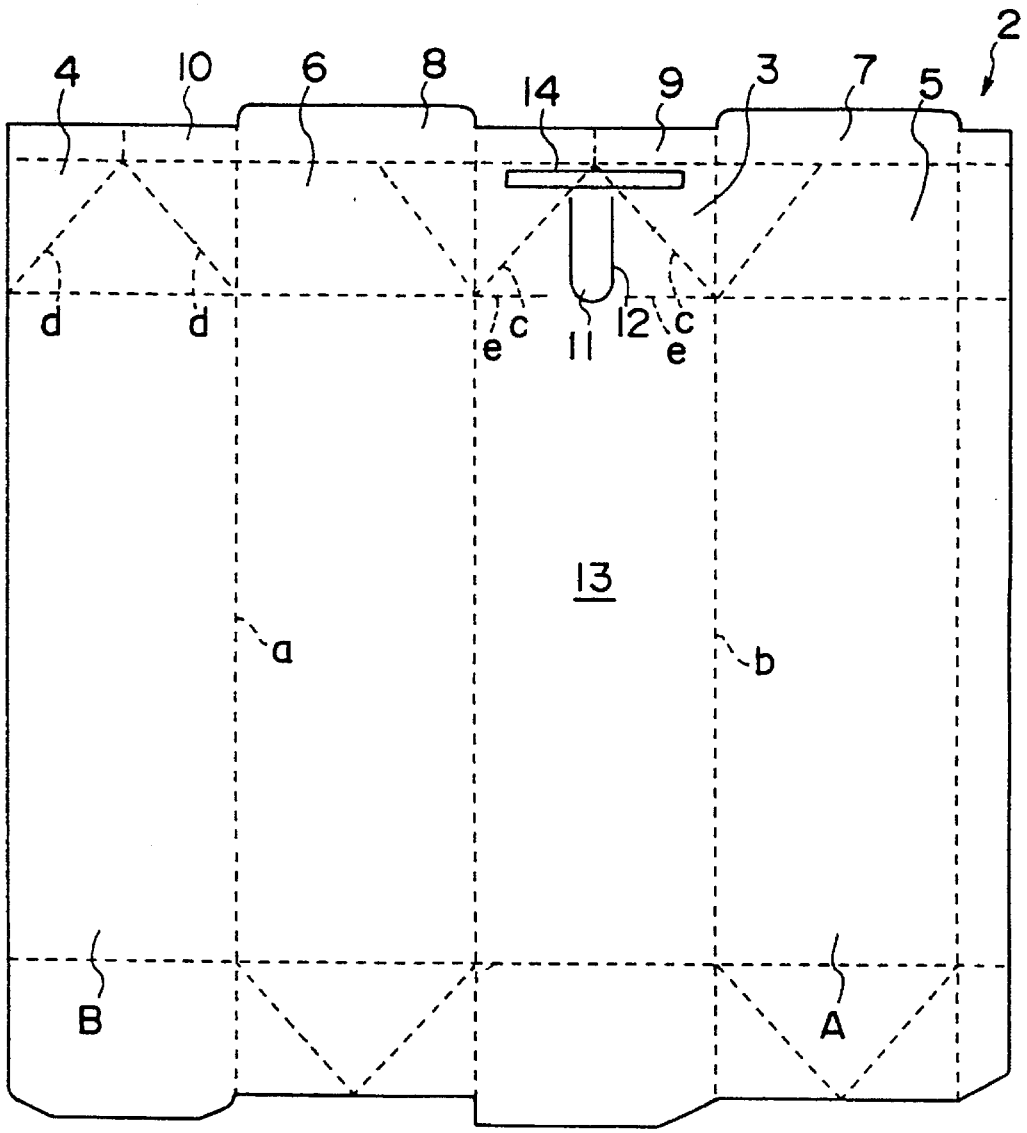
FIG. 2 is a development view of a blank of the paper container of FIG. 1.

The blank 2 with the stopper 14 applied thereto is conveyed to the heating roll 25. During this period, the stopper 14 is heated to further ensure application of the stopper 14 to the blank 2, and then cooled by the cooling roll 26. After the stopper 14 is cooled by the cooling roll 26, the blank 2 is discharged by the discharge means 32. Thus the blank 2 with the stopper 14 applied thereto as shown in FIG. 2 is prepared.

As described above, according to the stopper applying apparatus of the present invention, a plastic tape 30 is continuously fed from the tape feed means 22, and is cut by the cutter roll 24 to become a stopper. Then the stopper 14 is transferred to the suction roll 23, and then transferred from the suction roll 23 to the press-application means 21. The stopper 14 is press-applied to the blank 2 by the press application means 2, whereby the stopper 14 can be easily and quickly applied to the stopper application part on the blank.

According to first and second features of the present invention, the tab region is pulled into the tab, and the tab is continuously pulled to tear the seal between the top rib and the top folded-in rib, whereby the top folded-in side panels can be easily raised. The tab is formed simply by providing the half cut for defining the tab region, and the stopper for prohibiting breakage of the tab is simply provided, which makes the manufacture of the container easy. The tab is not raised until the container is opened, accordingly the tab does not get in the way of setting up the blank without causing troubles.

According to a third feature, a plastic tape fed by the tape feed means is cut by the cutter roll to become a stopper, and the stopper is transferred from the first sucking portion of the suction roll to the second sucking portion of the press application means, where the stopper is heated by the heating means of the press-application means and then applied to a blank by the press-application means, whereby the stopper can be easily and quickly applied to a blank, which can improve production efficiency in the manufacture of the blank.

What is claimed is:

1. A paper container made of a blank, comprising:

a top closed portion including a pair of top folded-in side panels opposed to each other, each said top folded-in side panel having a top folded-in rib and slant fold lines along which each said top folded-in side panel is folded in, and a pair of top side panels opposed to each other, each said top side panel having a top rib and being bent inward to hold said top folded-in ribs between said top ribs;

four side panels below said top closed portion; and a bottom below said four side panels, wherein a tab region half cut for defining a tab region is formed in a substantially central part of one of said top folded-in side panels, said tab region having a shape which is open at its top and closed at its bottom, and a stopper is applied to a part near a top end of said tab region.

2. The paper container of claim 1, wherein a lower end of said tab region half cut extends below a boundary between said one of said top folded-in side panels and an adjacent one of said side panels.

3. The paper container of claim 1, wherein a fold line is provided on a boundary between said one of said top folded-in side panels and an adjacent one of said side panels, and said fold line does not interfere with a lower part of said tab region half cut.

4. The paper container of claim 1, wherein said tab region half cut is provided between said slant fold lines.

5. The paper container of claim 1, wherein a pair of upper ends of said tab region half cut terminate as inward arcs.

6. The paper container of claim 1, wherein a pair of upper ends of said tab region half cut terminate as outward arcs.

7. The paper container of claim 1, wherein arcuate half cuts are provided at a pair of upper ends of said tab region half cut.

8. The paper container of claim 1, wherein horizontal linear half cuts are provided at a pair of upper ends of said tab region half cut.

9. The paper container of claim 1, wherein circular half cuts are provided at a pair of upper ends of said tab region half cut.

10. The paper container of claim 1, wherein said blank comprises a paper layer and a pair of plastic layers disposed on exterior and interior surfaces of said paper layer, and said stopper has a thickness 6 to 8 times that of the exterior plastic layer of said blank.

11. A paper container made of a blank, comprising:

a top closed portion including a pair of top folded-in side panels opposed to each other, each said top folded-in side panel having a top folded-in rib and slant fold lines along which each said top folded-in side panel is folded in, and a pair of top side panels opposed to each other, each said top side panel having a top rib and being bent inward to hold said top folded-in ribs between said top ribs;

four side panels below said top closed portion; and a bottom below said four side panels, wherein a stopper is applied to a substantially central part of one of said top folded-in side panels and a tab region half cut for defining a tab region is formed from a surface layer of said stopper, said tab region having a shape which is open at its top and closed at its bottom.

12. The paper container of claim 11, wherein a lower end of said tab region half cut extends below a boundary between said one of said top folded-in side panels and an adjacent one of said side panels.

13. The paper container of claim 11, wherein a fold line is provided on a boundary between said one of said top folded-in side panels and an adjacent one of said side panels, and said fold line does not interfere with a lower part of said tab region half cut.

14. The paper container of claim 11, wherein said tab region half cut is provided between said slant fold lines.

15. The paper container of claim 11, wherein a pair of upper ends of said tab region half cut terminate as inward arcs.

16. The paper container of claim 11, wherein a pair of upper ends of said tab region half cut terminate as outward arcs.

17. The paper container of claim 11, wherein arcuate half cuts are provided at a pair of upper ends of said tab region half cut.

18. The paper container of claim 11, wherein horizontal linear half cuts are provided at a pair of upper ends of said tab region half cut.

19. The paper container of claim 11, wherein circular half cuts are provided at a pair of upper ends of said tab region half cut.

20. The paper container of claim 11, wherein said blank comprises a paper layer and a pair of plastic layers disposed on exterior and interior surfaces of said paper layer, and said stopper has a thickness 6 to 8 times that of the exterior plastic layer of said blank.

* * * * *